US011165181B2

(12) United States Patent
Sugimoto

(10) Patent No.: US 11,165,181 B2
(45) Date of Patent: Nov. 2, 2021

(54) FEMALE TERMINAL

(71) Applicant: Sumitomo Wiring Systems, Ltd., Mie (JP)

(72) Inventor: Yuki Sugimoto, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/828,176

(22) Filed: Mar. 24, 2020

(65) Prior Publication Data

US 2020/0313330 A1 Oct. 1, 2020

(30) Foreign Application Priority Data

Mar. 26, 2019 (JP) ..... JP2019-057807

(51) Int. Cl.

*H01R 13/00* (2006.01)
*H01R 13/193* (2006.01)
*H01R 13/11* (2006.01)
*H01R 4/18* (2006.01)

(52) U.S. Cl.

CPC ..... *H01R 13/193* (2013.01); *H01R 13/113* (2013.01); *H01R 4/185* (2013.01)

(58) Field of Classification Search

CPC .... H01R 13/193; H01R 13/113; H01R 13/15; H01R 13/187; H01R 13/10; H01R 13/04; H01R 13/02

USPC ..... 439/850–855

See application file for complete search history.

(56) References Cited

U.S. PATENT DOCUMENTS 4,579,409 A * 4/1986 Enneper ..... H01R 13/20 439/266
5,839,925 A * 11/1998 Simmons ..... H01R 13/113 439/852
7,374,465 B2 * 5/2008 Tanaka ..... H01R 13/113 439/595
7,470,159 B2 * 12/2008 Hara ..... H01R 13/113 439/595
8,944,861 B2 * 2/2015 Amano ..... H01R 13/113 439/852
2003/0109181 A1 * 6/2003 Bungo ..... H01R 13/193 439/852

FOREIGN PATENT DOCUMENTS

JP 2006-344474 12/2006

* cited by examiner

*Primary Examiner* — Harshad C Patel
(74) *Attorney, Agent, or Firm* — Gerald E. Hespos; Michael J. Porco; Matthew T. Hespos

(57) ABSTRACT

It is aimed to provide a female terminal capable of suppressing the rattling of a tab. A female terminal (10) of the present disclosure is fit to a male terminal (20) and includes a bottom wall (26), a resilient contact piece (14) and rattling suppressing portions (18). The resilient contact piece (14) is cantilevered from the bottom wall (26) and resiliently contacts the male terminal 20 by being displaced toward the bottom wall (26). The rattling suppressing portions (18) can contact the male terminal (20) when the male terminal (20) is displaced toward the bottom wall (26).

2 Claims, 9 Drawing Sheets

FEMALE TERMINAL

BACKGROUND

Field of the Invention

This disclosure relates to a female terminal.

Related Art

Japanese Unexamined Patent Publication No. 2006-344474 discloses a female terminal fitting with a rectangular tubular body that is open in a front-rear direction. A resilient contact piece is formed from a tongue that extends from a front end of a bottom plate of the body. The tongue is bent into the body and has a contact that contacts a tab of a male terminal fitting when the tab is inserted into the body. An excessive deflection restricting plate is formed by cutting and raising the bottom plate and is located on the underside of the contact of the resilient contact piece. The female terminal fitting is fit to a male terminal fitting that has a tab formed on the tip of the male terminal fitting. The tab is inserted through a front opening in the body of the female terminal fitting. Thus, the tab contacts the contact of the resilient contact piece and deforms the resilient contact piece resiliently toward the bottom plate. An excessive deflection restricting plate is formed by cutting and raising the bottom plate. The excessive deflection restricting plate prevents excessive deflection of the resilient contact piece toward the bottom plate.

Vibration may occur while the male terminal fitting is fit to the female terminal fitting. Such vibration could cause the tab to push the resilient contact piece toward the bottom plate. The resilient contact piece can be displaced between the lower surface of the resilient contact piece and the excessive deflection restricting plat. Thus, the tab rattles.

SUMMARY

This disclosure is directed to a female terminal to be fit to a male terminal. The female terminal includes a bottom wall, a resilient contact piece, and a rattling suppressing portion. The resilient contact piece is cantilevered from the bottom wall and resiliently contacts the male terminal by being displaced toward the bottom wall. The rattling suppressing portion is capable of contacting the male terminal when the male terminal is displaced toward the bottom wall.

The male terminal that is displaced toward the bottom wall contacts the rattling suppressing portion. Thus, the male terminal is restricted from being displaced toward the bottom wall and rattling.

Two of the rattling suppressing portions may be provided and may be spaced apart in a width direction perpendicular to both a fitting direction of the male terminal and a displacing direction of the resilient contact piece. Thus, one of the rattling suppressing portions contacts the male terminal if the male terminal is going to be twisted and suppresses such twisting.

The female terminal may include an excessive deflection restricting portion for restricting excessive deflection of the resilient contact piece by contacting the resilient contact piece when the resilient contact piece is displaced toward the bottom wall. The rattling suppressing portion may be integral to the excessive deflection restricting portion, and the resilient contact piece may have a cutout for preventing interference with the rattling suppressing portion.

The resilient contact piece contacts the excessive deflection restricting portion when being displaced toward the bottom wall to prevent excessive deflection of the resilient contact piece. Further, the resilient contact piece may include the cutout. Thus, the rattling suppressing portion can be integral to the excessive deflection restricting portion while preventing interference of the rattling suppressing portion with the resilient contact piece. Both the excessive deflection restricting portion and the rattling suppressing portion can be provided at one position if it is difficult to provide the excessive deflection restricting portion and the rattling suppressing portion at different positions, for example, due to the size restriction.

According to this disclosure, the female terminal suppresses rattling of a tab.

DETAILED DESCRIPTION

A specific example of a female terminal 10 of the present disclosure is described below with reference to the drawings. Note that the present disclosure is not limited to these illustrations and is intended to be represented by claims and include all changes in the scope of claims and in the meaning and scope of equivalents.

Figure 1:
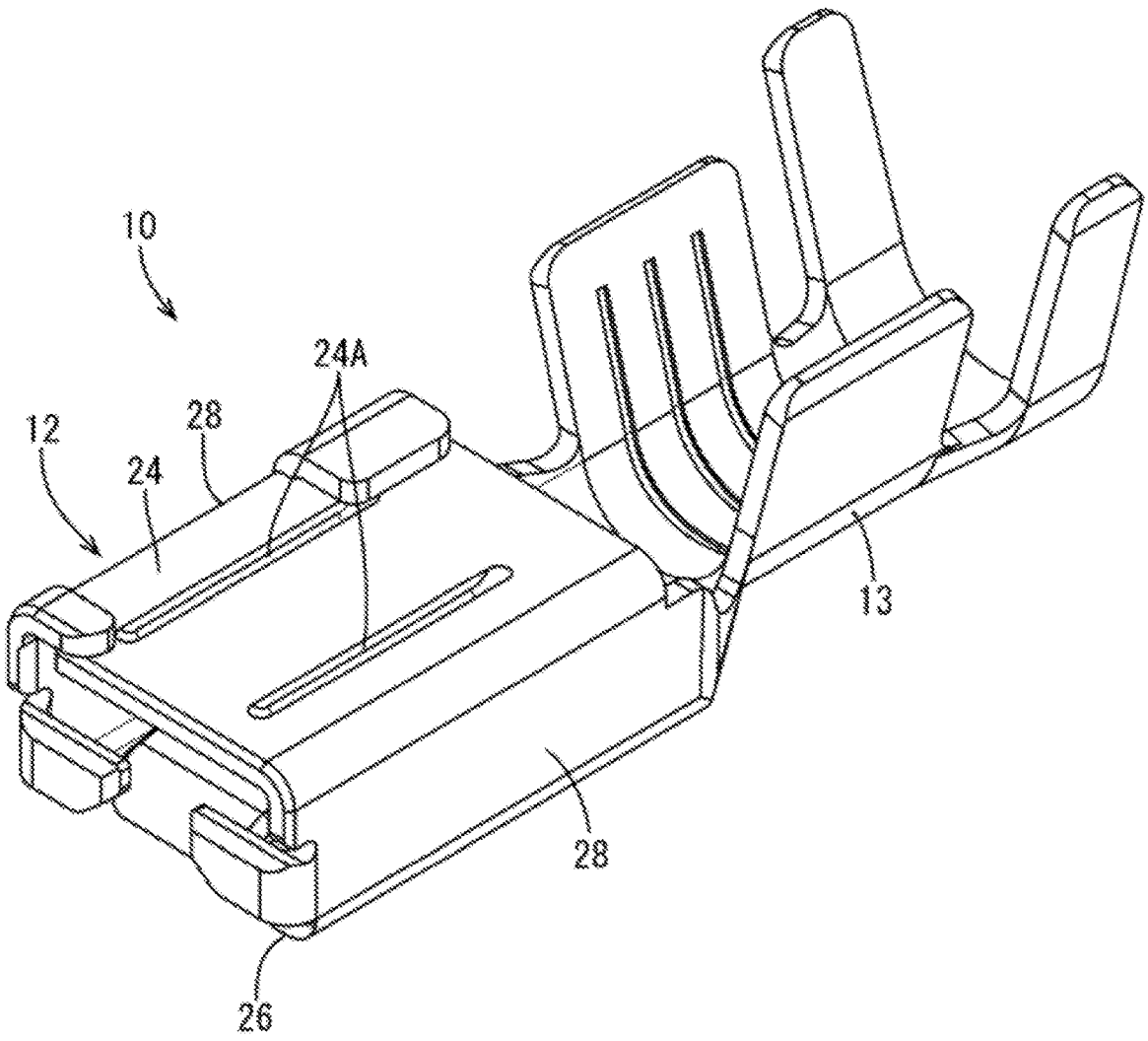
FIG. 1 is a perspective view of a female terminal according to an embodiment.
Figure 4:
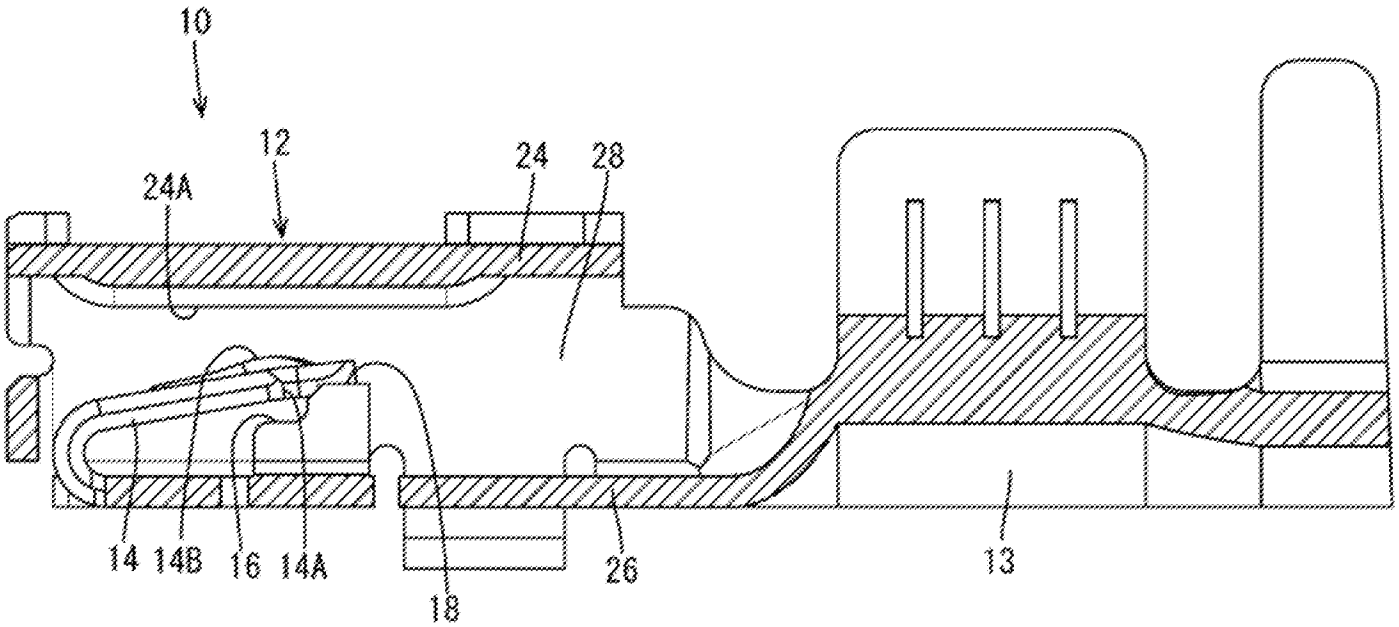
FIG. 4 is a section along A-A in FIG. 3.
Figure 8:
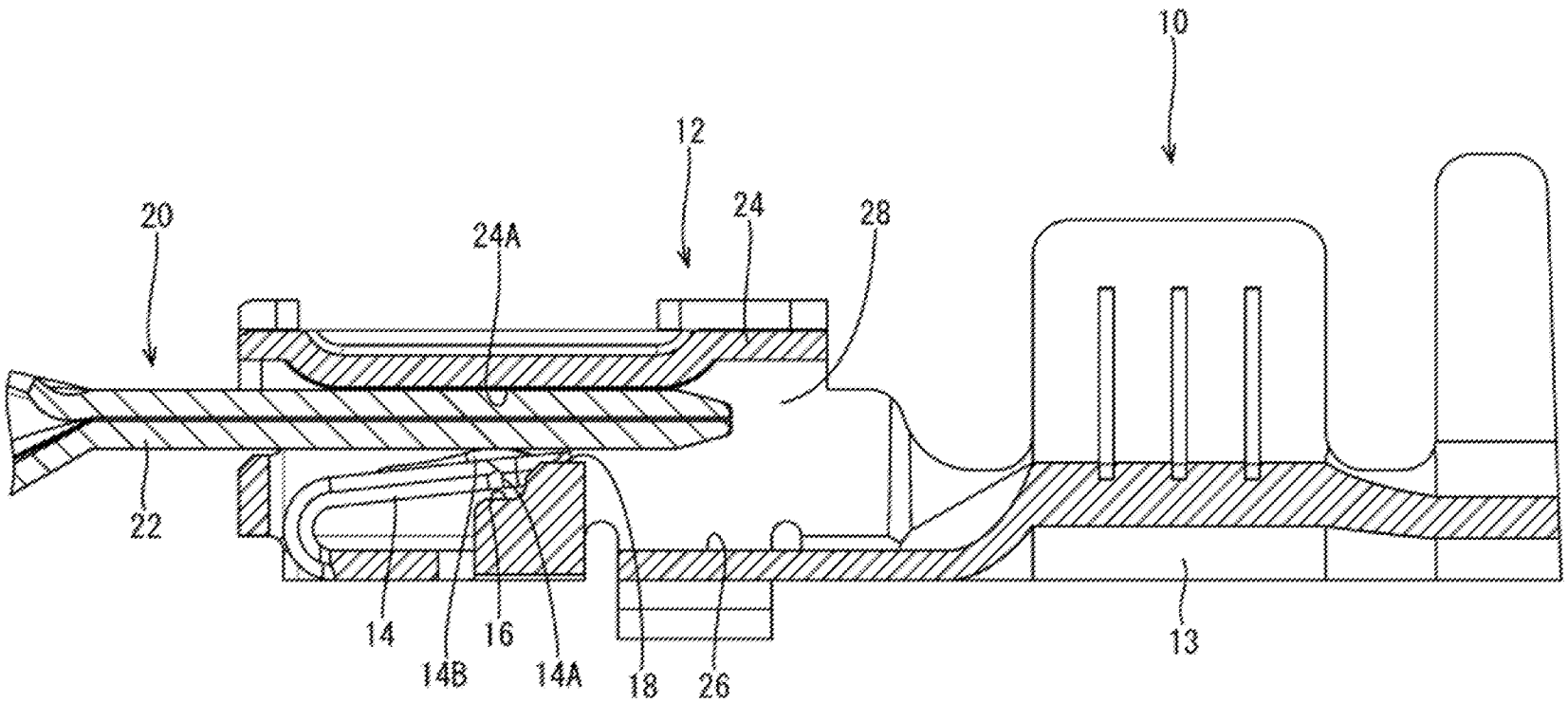
FIG. 8 is a section along C-C in FIG. 7.

As shown in FIG. 1, the female terminal 10 includes a body 12 and a wire connecting portion 13. As shown in FIG. 4, a resilient contact piece 14 and excessive deflection restricting portions 16 are provided inside the body 12. As shown in FIG. 8, a male terminal 20 to be fit to the female terminal 10 includes a tab 22 in the form of a plate that is long in a front-rear direction (fitting direction of the male terminal 20).

As shown in FIG. 1, the body 12 is a rectangular tube long in the front-rear direction and open in the front-rear direction, as shown in FIG. 4. The body 12 includes a ceiling wall 24 and a bottom wall 26 facing each other in the vertical direction, and two side walls 28 facing each other in a lateral direction. The ceiling wall 24 couples the upper ends of the side walls 28, whiles the bottom wall 26 couples the lower ends of the side walls 28 to each other. The wire connecting portion 13 to be connected to a wire (not shown) is provided behind the body 12 and is connected to and behind the bottom wall 26 of the body 12.

Figure 3:
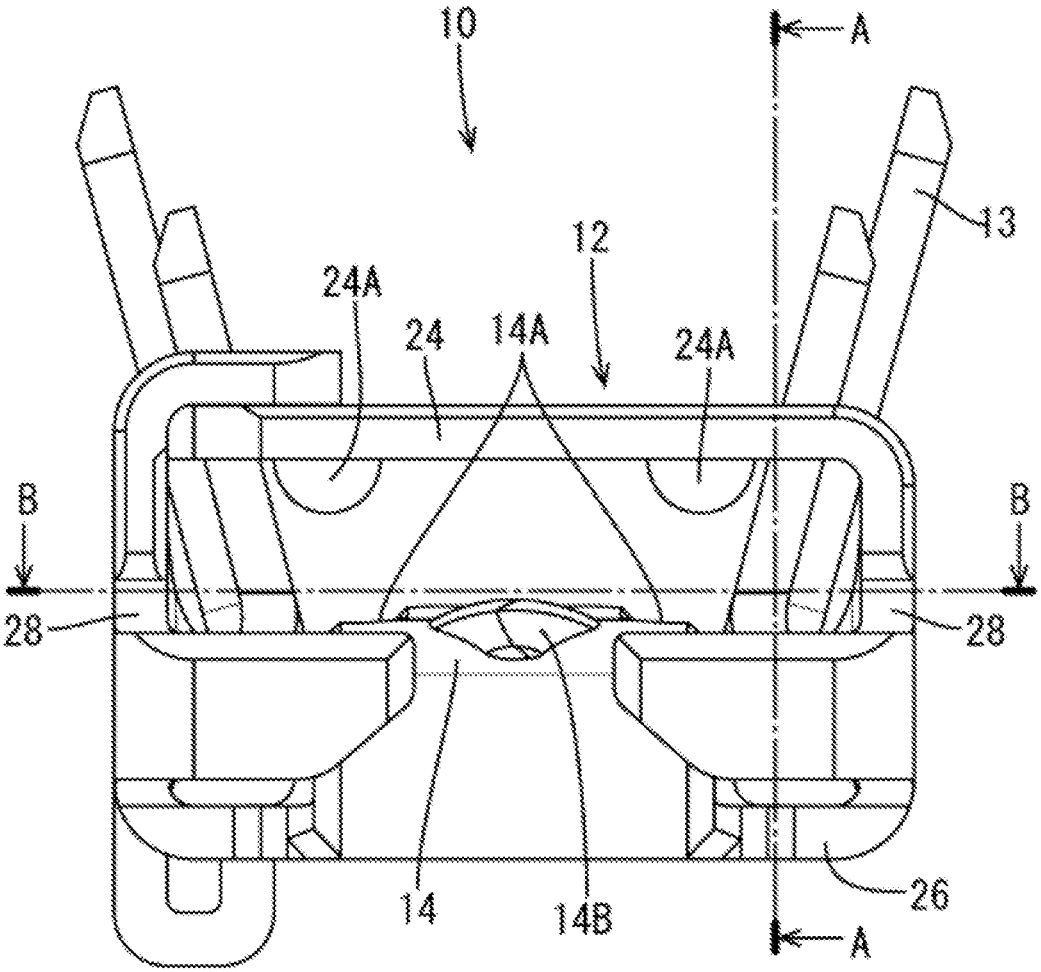
FIG. 3 is a front view of the female terminal.
Figure 5:
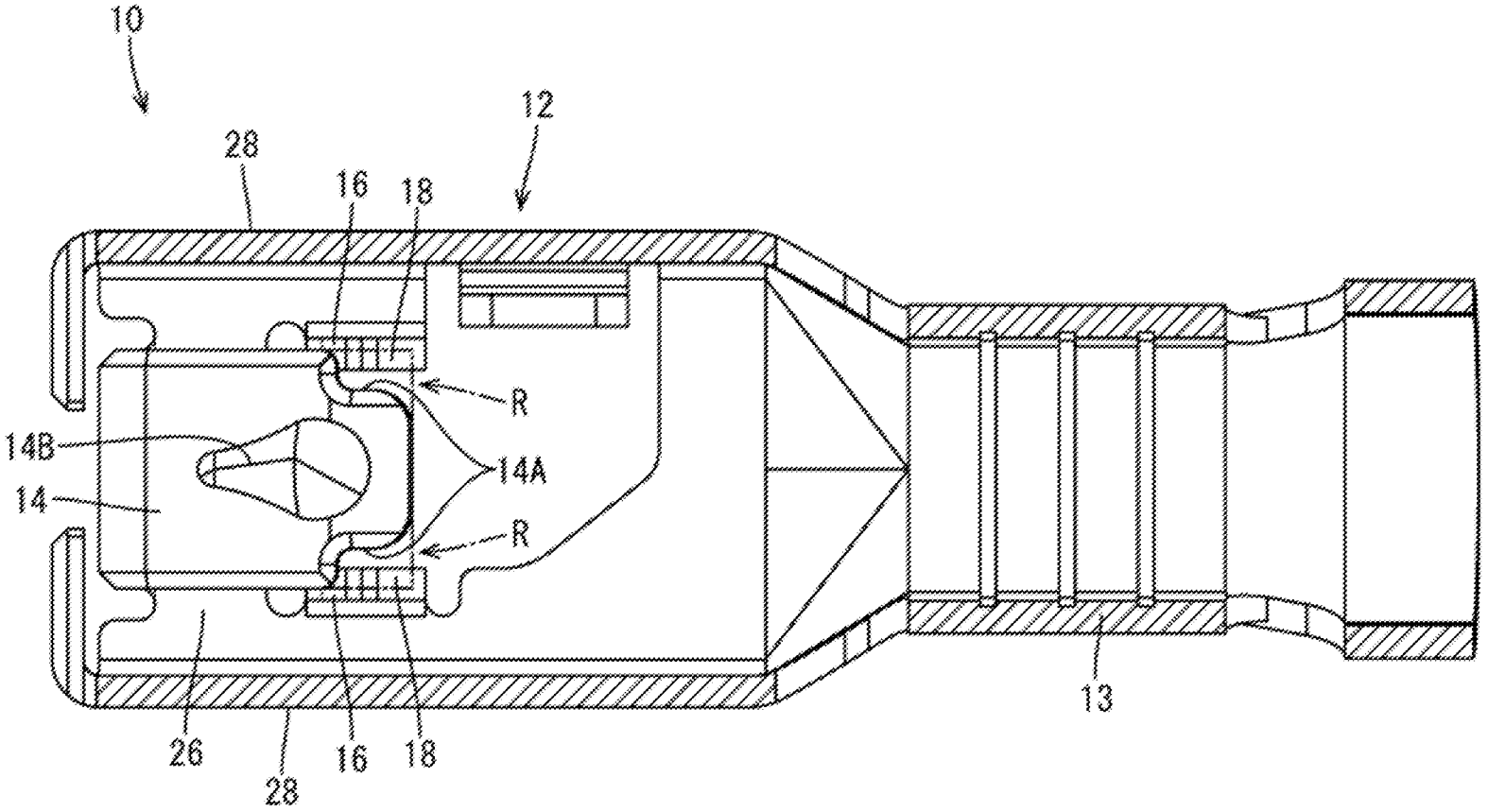
FIG. 5 is a section along B-B in FIG. 3.

As shown in FIG. 4, the resilient contact piece 14 is folded rearward and cantilevered from the front end of the bottom wall 26 in the body 12. The resilient contact piece 14 can be displaced resiliently down toward the bottom wall 26. As shown in FIG. 5, the resilient contact piece 14 is provided with two cutouts 14A. The cutouts 14A are formed into an L shape from rear parts of both side edges to the rear end edge of the resilient contact piece 14. Specifically, the cutouts 14A are formed by cutting off both corners on the rear end of the resilient contact piece 14. As shown in FIGS. 3 and 4, a contact 14B projects up from the upper surface of the resilient contact piece 14.

As shown in FIG. 3, the ceiling wall 24 has two beads 24A that are spaced apart in the lateral direction (width direction perpendicular to the fitting direction of the male terminal 20 and a displacing direction of the resilient contact piece 14). The beads 24A project down from the lower surface of the ceiling wall 24. Further, as shown in FIG. 4, the beads 24A are long in the front-rear direction.

Figure 6:
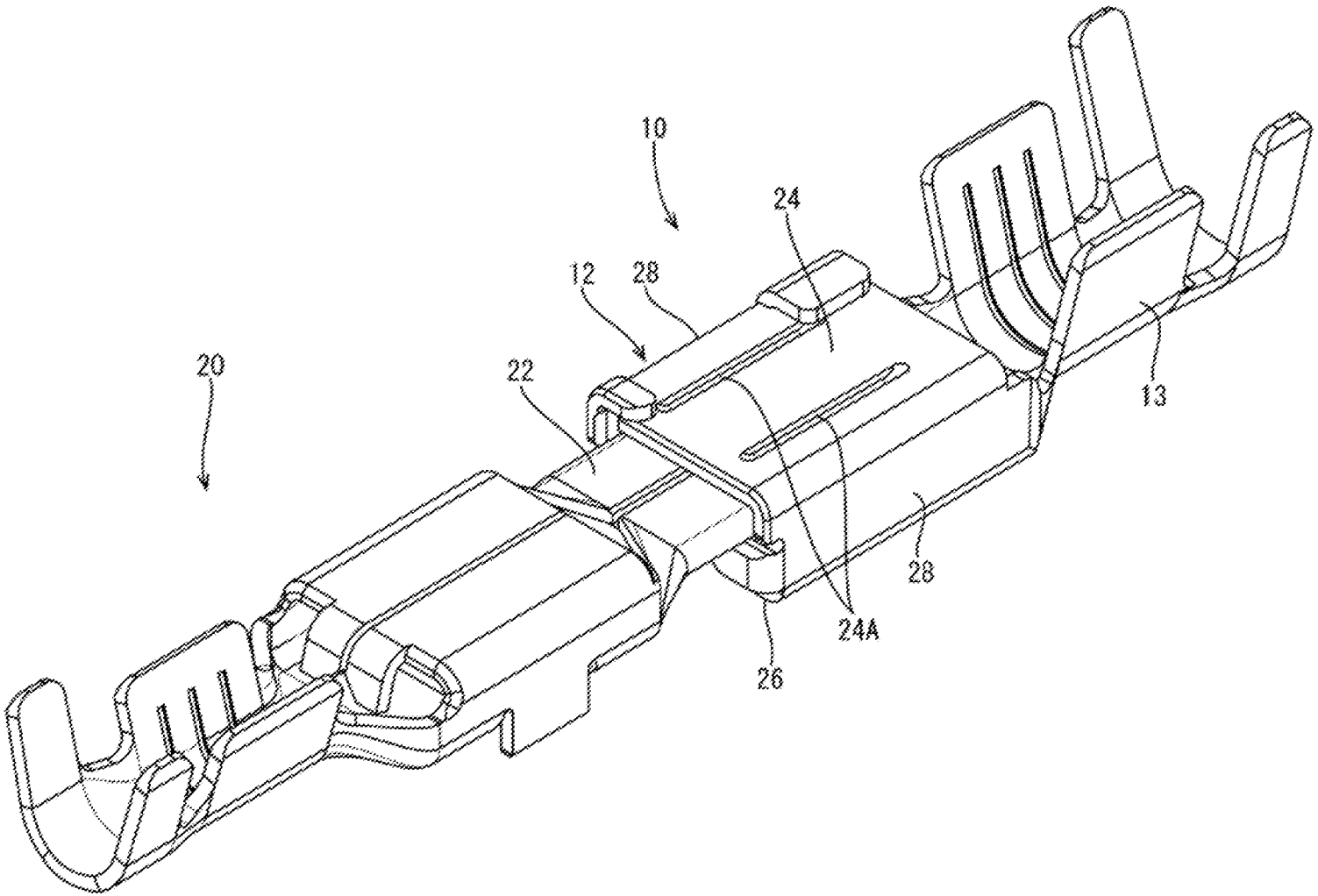
FIG. 6 is a perspective view of the female terminal in a state fit to a male terminal.
Figure 7:
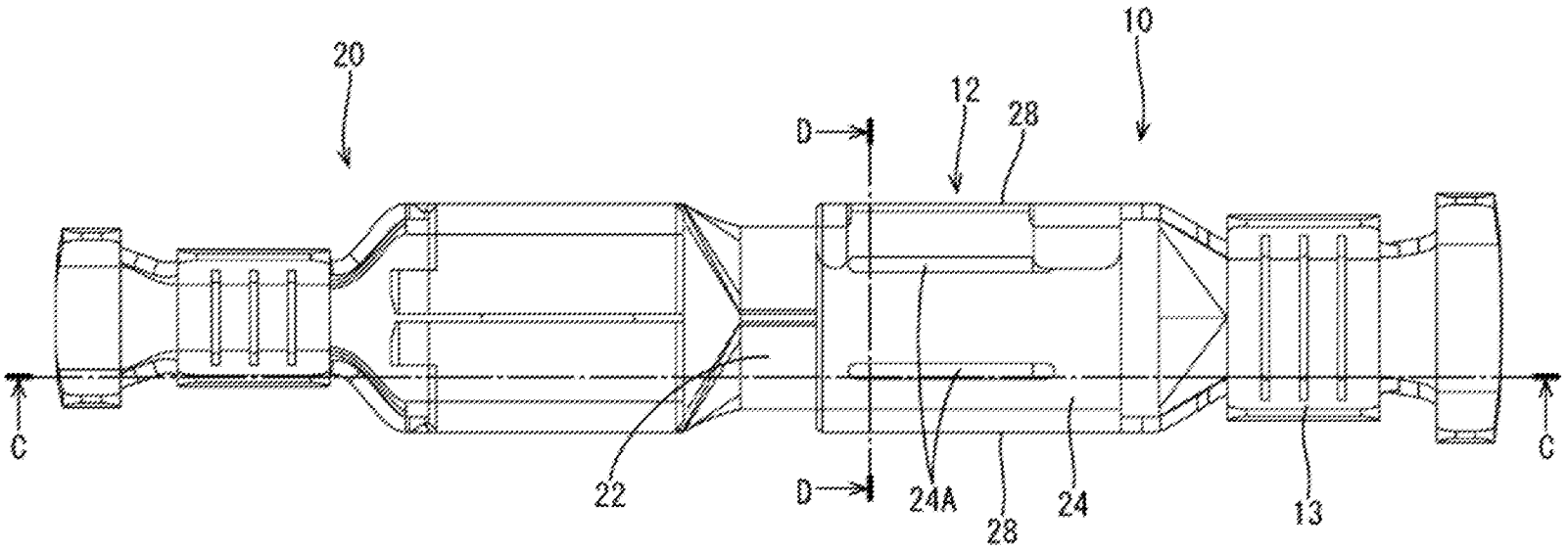
FIG. 7 is a plan view of the female terminal in the state fit to the male terminal.

As shown in FIGS. 6 and 7, the tab 22 of the male terminal 20 is inserted into the body 12 through the front opening of the body 12. When the male terminal 20 is fit to the female terminal 10, as shown in FIG. 8, the contact 14B of the resilient contact piece 14 resiliently contacts the tab 22 from below. In this way, the tab 22 is pushed up to contact the beads 24A and the male terminal 20 and the female terminal 10 are connected electrically.

Figure 2:
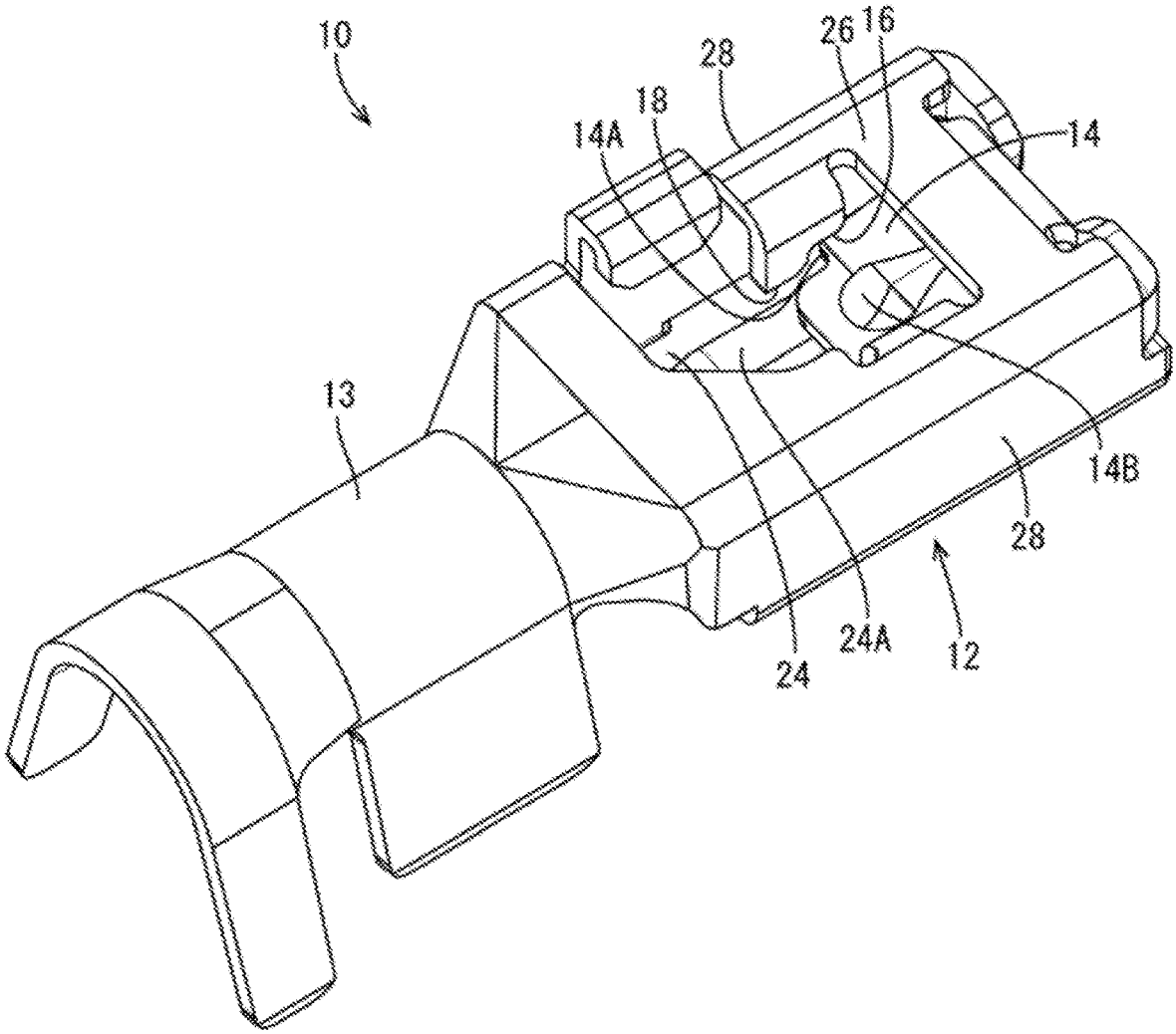
FIG. 2 is a perspective view of the female terminal viewed from a bottom surface.

As shown in FIGS. 2, 4 and 5, left and right excessive deflection restricting portions 16 are formed by cutting and raising a part of the bottom wall 26 upward. The excessive deflection restricting portions 16 partially face the lower surface of the resilient contact piece 14. For example, if the male terminal 20 is inserted obliquely into the body 12, the tab 22 strongly contacts the resilient contact piece 14 and the resilient contact piece 14 is displaced down a significant distance. Thus, the lower surface of the resilient contact piece 14 contacts the excessive deflection restricting portions 16 to hinder farther downward displacement of the resilient contact piece 14 and to prevent excessive deflection of the resilient contact piece 14.

As shown in FIGS. 4 and 5, the excessive deflection restricting portions 16 have left and right rattling suppressing portions 18 are provided. The rattling suppressing portions 18 are integral to the excessive deflection restricting portions 16 and project up from the upper end of the excessive deflection restricting portions 16. As shown in FIG. 5, a part of the rattling suppressing portion 18 is located in the cutout portion 14A (range of dotted line R in FIG. 5) of the resilient contact piece 14.

Figure 9:
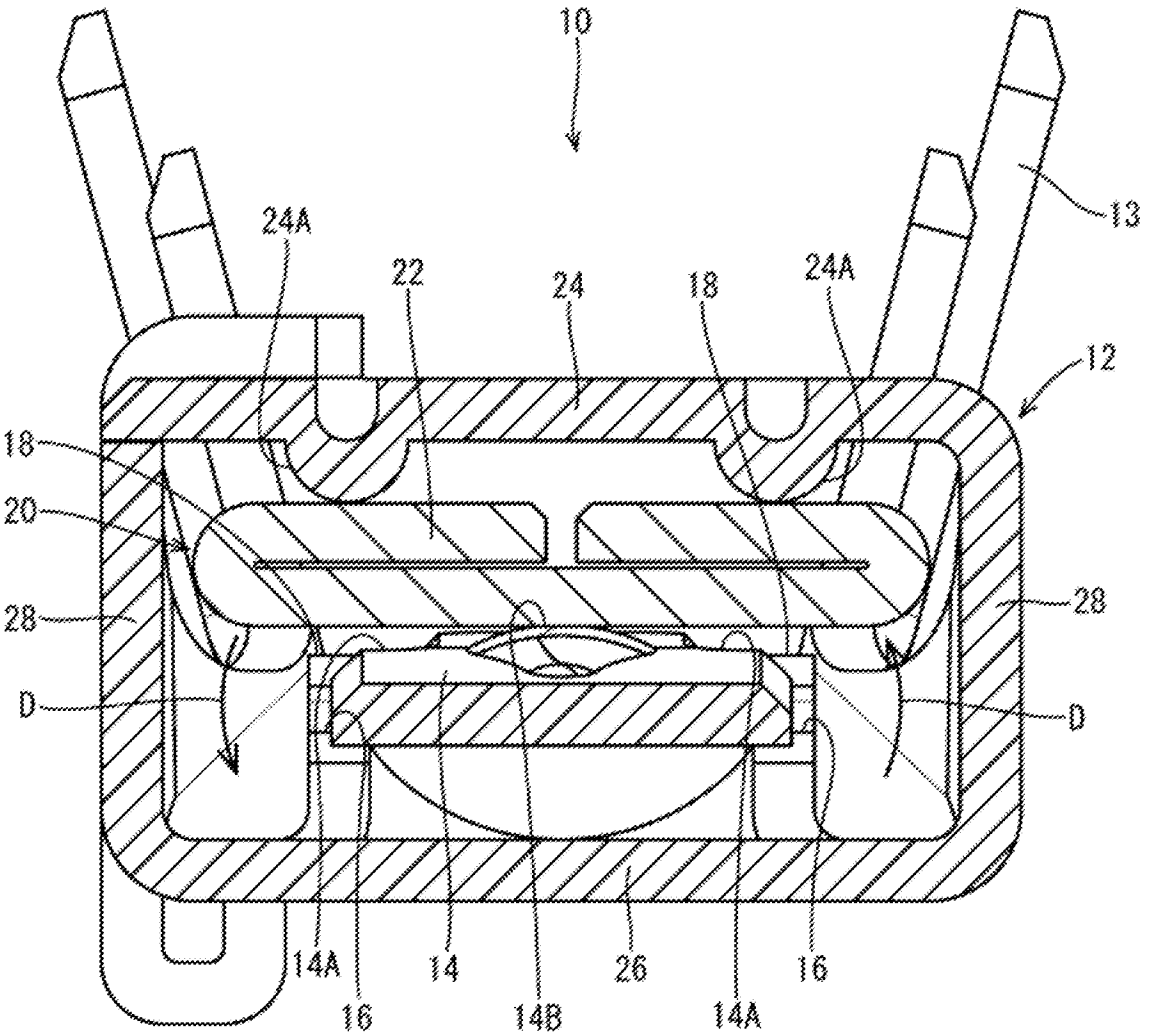
FIG. 9 is a section along D-D in FIG. 7.

As shown in FIGS. 8 and 9, the rattling suppressing portions 18 face the lower surface of the tab 22 with the male terminal 20 and the female terminal 10 fit. If the male terminal 20 shakes in the vertical direction, for example, due to vibration or the like, the tab 22 contacts the rattling suppressing portions 18 while pressing the resilient contact piece 14 down, thereby hindering any farther downward displacement of the resilient contact piece 14. Thus, a vertical displacement width of the tab 22 is smaller as compared to the case where the rattling suppressing portions 18 are not provided, and rattling of the tab 22 can be suppressed. By suppressing the rattling of the tab 22, it is possible to suppress the wear of the resilient contact piece 14 due to sliding movements of the tab 22 and the resilient contact piece 14 under a vibrating environment. Therefore, connection reliability between the male terminal 20 and the female terminal 10 can be ensured.

By providing the resilient contact piece 14 with the cutouts 14A, the rattling suppressing portions 18 can be integral to the excessive deflection restricting portions 16 while the interference of the rattling suppressing portions 18 with the resilient contact piece 14 is prevented. For example, if the resilient contact piece 14 is not provided with the cutouts 14A, rattling suppressing portions need to be provided at positions so as not to interfere with the resilient contact piece. Specifically, the rattling suppressing portions need to be provided outside the ranges of the dotted line R shown in FIG. 5 (e.g. on both sides of or behind the resilient contact piece). In such a case, the rattling suppressing portions and the excessive deflection restricting portions need to be at different positions. Thus, by providing the cutout 14A, both the excessive deflection restricting portion 16 and the rattling suppressing portion 18 can be provided at one position even if it is difficult to provide the excessive deflection restricting portion 16 and the rattling suppressing portion 18 at different positions, for example, due to a size restriction of the female terminal 10.

If the male terminal 20 is going to be twisted in a rotating direction indicated by an arrow D as shown in FIG. 9, the tab 22 contacts the left rattling suppressing portion 18 to hinder rotation of the male terminal 20. Further, if the male terminal 20 is going to be twisted in a direction opposite to the rotating direction indicated by the arrow D, the tab 22 contacts the right rattling suppressing portion 18 to hinder rotation of the male terminal 20. In this way, the rattling suppressing portions 18 prevent the twisting of the male terminal 20.

Other Embodiments

Although the resilient contact piece 14 is cantilevered rearward from the front end of the bottom wall 26 in the above embodiment, there is no limitation to this. For example, a resilient contact piece may be cantilevered forward from a rear end side of a bottom wall.

Although the rattling suppressing portion 18 is integral to the excessive deflection restricting portion 16 in the above embodiment, there is no limitation to this. For example, a rattling suppressing portion may be separate from an excessive deflection restricting portion.

Although the resilient contact piece 14 includes the cutouts 14A in the above embodiment, there is no limitation to this. For example, a resilient contact piece may include no cutout portion. In this case, rattling suppressing portions ae provided at positions so as not to interfere with the resilient contact piece (e.g. on both sides of or behind the resilient contact piece).

Although the left and right excessive deflection restricting portions 16 are provided in the above embodiment, there is no limitation to this. For example, an excessive deflection restricting portion may be provided only on either one of left and right sides. Further, although the left and right rattling suppressing portions 18 are provided in the above embodiment, there is no limitation to this. For example, a rattling suppressing portion may be provided only on either one of left and right sides.

Although the excessive deflection restricting portions 16 and the rattling suppressing portions 18 are formed by being cut and raised from the bottom wall 26 in the above embodiment, there is no limitation to this. For example, excessive deflection restricting portions and rattling suppressing portions may be formed by being cut and raised from side walls. Further, the excessive deflection restricting portions and the rattling suppressing portions may be constituted by components separate from a body.

LIST OF REFERENCE SIGNS

10: female terminal
12: body portion
13: wire connecting portion
14: resilient contact piece
14A: cutout

14B: contact
16: excessive deflection restricting portion
18: rattling suppressing portion
20: male terminal
22: tab
24: ceiling wall
24A: bead
26: bottom wall
28: side wall

What is claimed is:

1. A female terminal to be fit to a male terminal, comprising:

a housing having a bottom wall;

a resilient contact piece cantilevered rearward from the bottom wall and resiliently contacting the male terminal by being displaced toward the bottom wall; and two laterally spaced walls projecting up from the bottom wall and, a front part of each of the laterally spaced walls defining an excessive deflection restricting portion facing a lower surface of the resilient contact piece to prevent excessive deformation of the resilient contact piece towards the bottom wall; and a rear part of each of the laterally spaced walls defining a rattling suppressing portion integral with the excessive deflection restricting portion and projecting up farther than the excessive deflection restricting portion and being laterally of the resilient contact piece, wherein:

the rattling suppressing portion is configured to contact the male terminal when the male terminal is displaced toward the bottom wall.

2. The female terminal of claim 1, wherein:

the resilient contact piece includes a cutout portion for preventing interference with the rattling suppressing portion.

* * * * *